United States Patent [19]

Riddle et al.

[11] 3,997,807

[45] Dec. 14, 1976

[54] MECHANICALLY ADJUSTABLE ELECTRON GUN APPARATUS

[75] Inventors: George Herbert Needham Riddle, Princeton; Robert Richard Demers, Trenton, both of N.J.

[73] Assignee: RCA Corporation, New York, N.Y.

[22] Filed: Sept. 15, 1975

[21] Appl. No.: 613,534

[30] Foreign Application Priority Data

May 27, 1975 United Kingdom ..... 23172/75

[52] U.S. Cl. ..... 313/449; 250/306; 250/311; 313/459

[51] Int. Cl.[2] ..... H01J 29/46

[58] Field of Search ..... 250/306, 311; 313/146, 313/441, 449, 459

[56] References Cited

UNITED STATES PATENTS

| | | | |
|---|---|---|---|
| 2,391,780 | 12/1945 | Hillier | 313/459 |
| 3,229,145 | 1/1966 | Jensen | 313/146 |

*Primary Examiner*—R. V. Rolinec
*Assistant Examiner*—Lawrence J. Dahl
*Attorney, Agent, or Firm*—Eugene M. Whitacre; William H. Meagher; Dilip A. Kulkarni

[57] ABSTRACT

An electron gun apparatus comprises a cathode subassembly which is movably mounted relative to a fixedly mounted and registered grid/anode subassembly to permit mechanical adjustment of the cathode with respect to the grid/anode subassembly. An evacuated chamber, including resilient bellows interconnecting the movably mounted cathode assembly to the fixedly mounted grid/anode subassembly for permitting the mechanical adjustment, houses the cathode and the grid/anode subassemblies. Means are provided for electrical energization of the cathode, the grid, and the anode. According to a further feature of the invention, the cathode comprises a line filament, and the grid and the anode are slotted for providing an elongated line image.

8 Claims, 3 Drawing Figures

MECHANICALLY ADJUSTABLE ELECTRON GUN APPARATUS

This invention relates to electron guns, and more particularly, to electron guns wherein the cathode subassembly is mechanically adjustable relative to the fixedly mounted and registered grid/anode subassembly.

Although the invention is herein described in the context of an electron gun apparatus for recording video signals, it has applications in other areas where the positioning flexibility and the mechanical stability of the electron source are of particular importance: for example, electron lithography, electron microscopy, to name a few.

In video recording, an electron beam is intermittently blanked for selectively exposing a coating of electron beam sensitive material on a storage medium (e.g., a disc) along a spiral groove provided therein in accordance with signals to be stored. The coating of the electron sensitive material is then developed for removing material from the exposed areas, thereby leaving a series of depressed regions along the spiral groove representative of the signals stored. The dimension of the selectively exposed areas transverse to the spiral groove (i.e., the width) is illustratively, 4 micrometers.

For video recording, one may, for example, use a pointed filament which provides a round image, approximately 0.2 micrometer in diameter, on the disc, and then sweep the round image transverse to the spiral groove to selectively expose areas having the width dimension of 4 micrometers. However, such a technique is typically limited to recording at speeds much slower than the playback speed (e.g., recording at 50 rpm when the playback speed is 450 rpm) because the filament brightness required to obtain the necessary beam current in order to record at the full playback speed would result in excessively short filament life (e.g., less than 1 hour), and because the sweep frequencies required to obtain close spacing between the successive sweeps would be inconveniently high (e.g., 200 MHz).

Pursuant to the principles of the present invention, the electron gun apparatus includes a line filament (e.g., length — 1,000 micrometers, diameter — 125 micrometers), a slotted grid (e.g., a slot length — 10,000 micrometers, slot width — 1,000 micrometers), and a slotted anode (e.g., slot length — 10,000 micrometers, slot width 1,500 micrometers) to provide a line source (e.g., length — 800 micrometers, width — 20 micrometers). For video recording, the line source is demagnified and focused on the disc. The longitudinal dimension of the demagnified image on the disc is made equal to the width dimension of the selectively exposed areas (e.g., 4 micrometers) in order to make the transverse sweeping of the electron beam unnecessary.

For satisfactory recording of video signals, it is desirable that the filament (i.e., cathode) be mechanically adjustable relative to the grid and the anode. This is particularly important where the electron gun apparatus includes a line filament rather than a pointed filament.

For such filament adjustment, one may, for example, provide a separate cathode/grid subassembly in which the grid is mechanically fixed, but the cathode is mechanically adjustable relative to the fixed grid and a fixed anode. This is done because ordinarily the anode is maintained at ground potential, while both the cathode and the grid are maintained at relatively high negative potentials (e.g., minus 10 and 11 kilovolts, respectively). The grid is mounted to the cathode to simplify electrical connections. The above-said technique, wherein the cathode/grid subassembly is separately mounted relative to the fixedly mounted anode, is undesirable for several reasons. First, it is difficult to construct an electron gun apparatus of the above-described type having a precise and rigid registration between the grid and the anode because the grid and anode are separately mounted. Second, any adjustment of the cathode relative to the grid may upset the registration of the grid with respect to the anode (e.g., make them antiparallel, make the grid and anode apertures crooked, etc.). Third, the motion which can be provided to the cathode within the cathode/grid subassembly is limited both in extent of motion and in degrees of freedom (e.g., tilt motion about an axis normal to the optical axis of the gun is difficult). Fourth, it is difficult to introduce motion to the cathode relative to the grid while at the same time (a) providing electrical insulation between the cathode and the grid (e.g., 1,000 volts), and between the cathode and the gun housing (e.g., 10,000 volts), and (b) providing vacuum tightness. Fifth, lack of rigid positioning between the cathode and the grid results in problems, such as thermal drifts.

Alternately, for filament adjustment, one may provide a separate cathode/grid subassembly which is mechanically adjustable relative to a fixed anode, but in which the cathode is fixedly mounted with respect to the grid. The above-said technique, wherein the cathode is fixedly mounted relative to the grid, is also undesirable because the technique, inter alia, does not permit adjustment of the cathode relative to the grid. It may be important to provide cathode adjustment for several reasons. First, the ability to adjust the distance between the cathode and the grid along the beam axis is desirable for controlling the brightness obtainable from the source. Second, the ability to tilt the cathode about the beam axis (Z-axis) and about an axis perpendicular to the beam axis (X-axis) is desirable when the cathode is a line filament.

In accordance with another feature of the present invention, the cathode subassembly is made mechanically adjustable relative to the fixedly mounted and registered grid/anode subassembly. The above-said technique (1) provides a simple and accurate registration between the grid and the anode, (2) allows the necessary manipulation of the cathode without the possibility of upsetting the grid/anode registration, and (3), at the same time, improves the mechanical stability of the gun against vibration and thermal drifts.

In accordance with a still further feature of the invention, the evacuated chamber provided for housing the cathode, the grid, and the anode comprises resilient bellows interconnecting the movably mounted cathode subassembly and the fixedly mounted grid/anode subassembly to permit mechanical adjustment of the cathode. The use of resilient bellows (1) reduces air leakages into the evacuated chamber, (2) increases the extent of cathode motion relative to the grid, and (3) improves the precision with which the cathode can be located with respect to the grid, as compared with other techniques, such as moving O-ring seals.

In the accompanying drawings in which like reference characters refer to similar parts:

Figure 1:
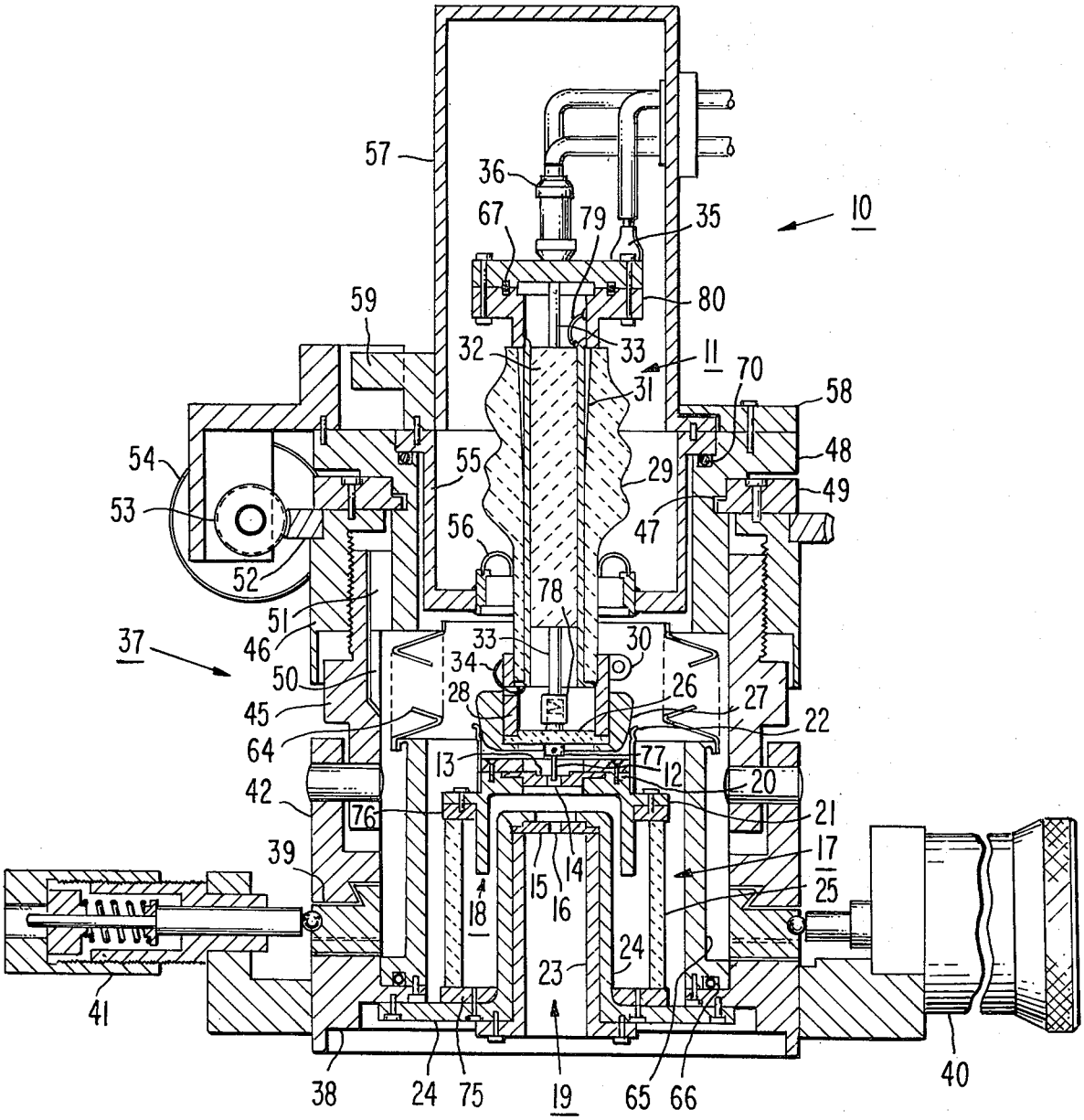
FIG. 1 is a partly sectioned elevation view of a mechanically adjustable electron gun apparatus pursuant to the principles of the present invention.

Referring now to the drawings, reference numeral 10 denotes a mechanically adjustable electron gun apparatus. The apparatus 10 includes a cathode subassembly 11 including a cathode (filament) 12 for providing a beam of electrons along an optical axis of the gun. A grid 13, including an aperture 14, is provided for shaping and modulating the electron beam. An anode 15, including an aperture 16, is provided for further shaping and accelerating the modulated electron beam. The grid 13 and anode 15, together with the filament 12, comprise an electron gun which forms a source image. The source image, illustratively, has a cross-section of the order of 800 × 20 micrometers. For recording, the source image is demagnified and focused by a lens system (not shown) on the disc. The demagnified image of the source on the disc, illustratively, has a cross-section of the order of 4 × 0.1 micrometers.

A grid/anode subassembly 17 includes a grid structure 18 fixedly secured to an anode structure 19. The grid structure 18 comprises the grid 13 securely held by a releasable grid clamp 20 in a seat provided in a grid base 21. In order to establish electrical connection with the grid 13, in this particular embodiment, the grid base 21 is made of conductive material and a multiple of conductive flexible fingers 22 are secured to the grid base. The electrical connection to the grid 13 will be described subsequently. The anode structure comprises the anode 15 securely held by a releasable anode clamp 23 in a seat provided in an anode base 24. It is noted that when the grid/anode subassembly 17 has been separated from the electron gun apparatus 10, the grid 13 and the anode 15 are easily accessible and can be readily removed: for example, for cleaning, replacement, etc. The grid structure 18 is fixedly mounted on the anode structure 19 by a non-conductive standoff 25 which is brazed to washers 76 and 75 secured to the grid base 20 and the anode base 24. The non-conductive standoff 25 also serves to electrically isolate the grid structure 18 from the anode structure 19. In construction of the grid/anode subassembly, it is desirable to machine the washers (75 and 76) after they have been brazed to the non-conductive standoff 25 in order to provide a precise alignment of the grid 13 and the anode 15. It is noted that the rigid and precise mounting of the grid structure 18 to the anode structure 19, via the non-conductive standoff 25 and the washers (75 and 76), (a) simplifies the task of manufacturing the gun with relatively fine positioning tolerances between the grid 13 and the anode 15, (b) makes unnecessary any further adjustments between the grid and the anode for alignment purposes during operation, (c) prevents relative motion between the grid and the anode during alignment of the filament 12, and (d) improves the stability of the gun against mechanical vibrations and thermal drifts.

The cathode subassembly 11 includes a non-conductive cathode support 26 carrying filament leads 77 (FIG. 3) to which the cathode 12 is welded. The non-conductive cathode support 26 is secured to a base member 28 by a clamp 27. The base 28 is secured to a tubular insulator 29 by a ring clamp 30. A conductive cylinder 31 is securely held between a rod insulator 32 and the tubular insulator 29. The rod insulator 32 has two bores (not shown) parallel to its axis for conductive cathode leads 33. The filament leads 77 are snugly received by conductive sockets 78 which are fastened to the conductive cathode leads 33. A conductive wire 34 electrically connects the conductive cylinder 31 to the base 28. A second conductive wire 79 electrically connects the conductive cylinder 31 to the conductive flange 80. Electrical connection is provided between the conductive flange 80 and a grid terminal 35.

In this particular embodiment, the anode 15 is maintained at ground potential. The clamp 27 and the base 28 are made of conductive materials. When the cathode subassembly 11 is operatively mounted, the flexible fingers 22 engage the clamp 27 to electrically connect the grid 13 to the grid terminal 35 maintained at the grid potential (e.g., approximately minus 11 kilovolts), via the grid base 20, flexible conductive fingers 22, conductive clamp 27, conductive base 28, wire 34, conductive cylinder 31, second wire 79, and conductive flange 80. It is noted that the flexible fingers 22 permit ready separation of the cathode subassembly 11 from the grid/anode subassembly 17 without the need for any complicated disconnections. Further, the flexible fingers 22 permit mechanical adjustment of the cathode relative to the fixedly mounted grid/anode subassembly without interrupting electrical coupling between the grid 13 and the second terminal 35. When the cathode subassembly is operatively mounted, the cathode leads 33 electrically connect the filament 12 to a pair of electrically insulated filament terminals 36 which are maintained at certain potentials (e.g., approximately minus 10 kilovolts).

Figure 3:
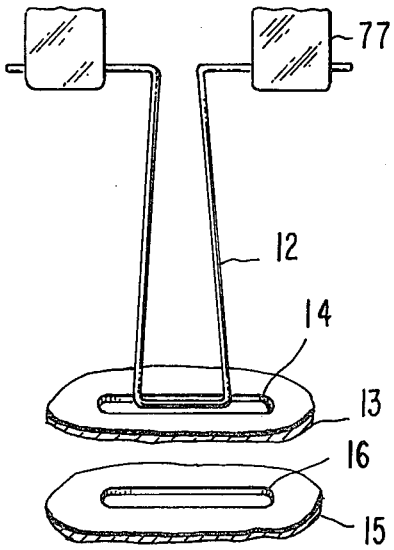
FIG. 3 illustrates a line filament, a slotted grid, and a slotted anode for providing a line image, and suitable for use in the electron gun apparatus of FIGS. 1 and 2.

In this particular embodiment, as illustrated in FIG. 3, the cathode 12 comprises a line filament (e.g., length — 1,000 micrometers, width — 125 micrometers), the aperture 14 of the grid 13 is slotted (e.g., slot length — 10,000 micrometers, slot width — 1,000 micrometers), and the aperture 16 of the anode 15 is also slotted (e.g., slot length — 10,000 micrometers, slot width — 1,500 micrometers). The grid 13 and the anode 15 thicknesses are approximately 250 micrometers and 625 micrometers respectively. The grid 13 and the anode 15 are located in parallel planes with the slots 14 and 16 in spatial registration. The separation between the grid 13 and the anode 15 is sufficient (e.g., 0.2 centimeters) to withstand the high potential difference between them (e.g., 11 kilovolts). The filament 12 is centered and arranged parallel to the slots 14 and 16 in the grid and the anode, respectively. The slotted grid 13 and the slotted anode 15, together with the line filament 12, when operative, provide an electron beam and form a source image having an elongated cross-section. The elongated cross-section of the source image defines a longitudinal axis and a latitudinal axis in quadrature (i.e., Y-axis and X-axis, respectively). The longitudinal dimension of the source image (e.g., 800 micrometers) is significantly greater than the latitudinal dimension of the source image (e.g., 20 micrometers).

Figure 2:
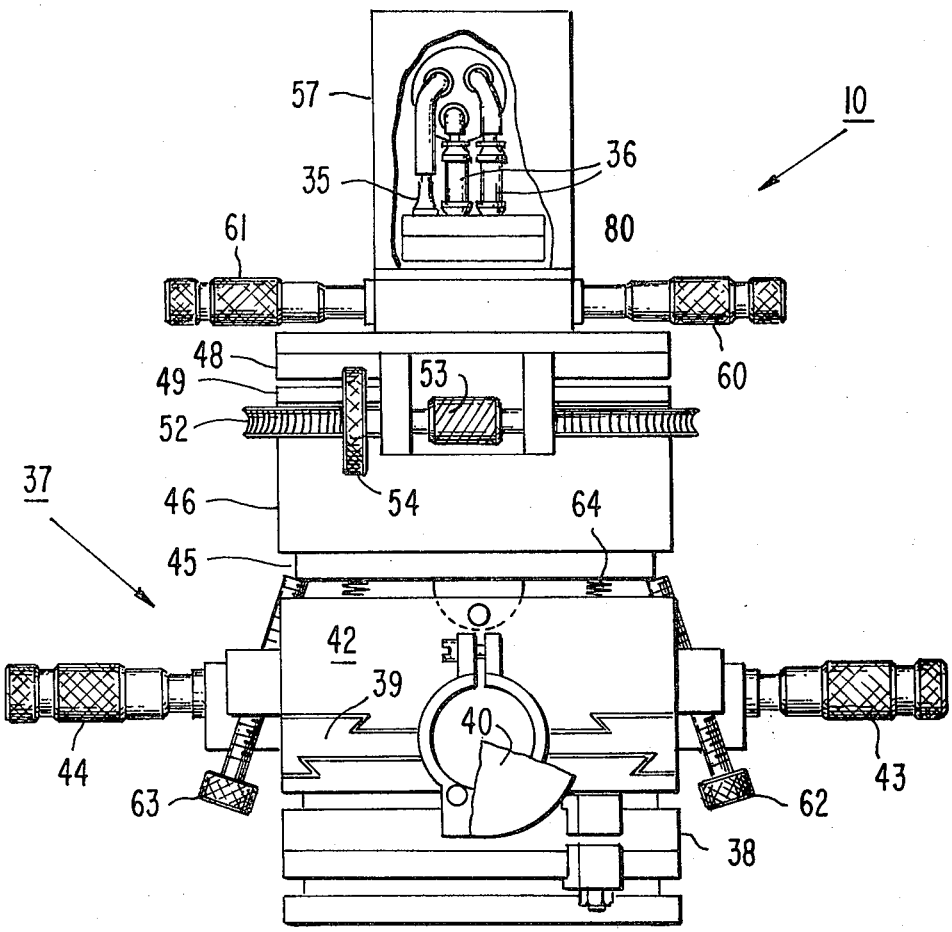
FIG. 2 is an exterior end view of the electron gun apparatus of FIG. 1, wherein a portion of the electron gun apparatus is broken away to show the electrical connections.

Referring again to FIG. 1, means 37 for movably mounting the cathode subassembly 11 to the grid/anode subassembly 17 includes a pedestal 38. The grid/anode subassembly 17 is fixedly secured to the pedestal 38. A first slide 39 is reciprocably mounted to the pedestal 38 for translatory motion along a first axis parallel to the latitudinal axis (i.e., X-motion). A micrometer 40 is provided for causing a controlled movement of the first slide 39 relative to the pedestal 38. A lock 41 is provided at the opposite end of the first slide 39 from the micrometer 40 to lock the first slide in the desired position. A second slide 42 is reciprocably mounted to the first slide 39 for translatory motion along a second axis parallel to the longitudinal axis (i.e., Y-motion). As illustrated in FIG. 2, micrometers 43 and 44 are provided for causing controlled motion of the second slide 42 with respect to the first slide 39. A housing 45 is tiltably mounted on the second slide 42 for pivotal motion about an axis parallel to the latitudinal axis (i.e., tilt around X-axis). Micrometers 62 and 63 are provided for causing controlled pivotal motion of the housing 45 about the latitudinal axis. Again, as illustrated in FIG. 1, a skirt 46, having a threaded portion, is provided for cooperation with the threaded portion of the housing 45. It is noted that the rotation of the skirt 46 relative to the housing 45 causes translatory motion of the skirt along a third axis which is nearly perpendicular to a plane defined by the longitudinal and latitudinal axes (i.e., Z-motion or motion along the beam axis). A groove 47 is provided in a casing 48 for receiving an insert 49 secured to the skirt 46. A slot 50 is provided in the housing 45 for receiving a key 51 secured to the casing 48 in order to prevent rotation of the casing relative to the housing 45. The insert 49 transmits translatory motion of the skirt 46 to the casing 48 while permitting the rotational motion of the skirt relative to the casing. A worm gear 52 is secured to the skirt 46 for engagement with a worm 53 rotatably mounted to the casing 48. A knurled thumbwheel 54 is secured to the shaft carrying the worm 53. The rotation of the thumb-wheel 54 causes rotation of the skirt 46 via the worm and worm gear drive thereby causing translatory motion of the casing 48 along the nearly perpendicular third axis.

A holder 55 is rotatably mounted on the casing 48 for rotational motion about the nearly perpendicular third axis (i.e., tilt around Z-axis). A cathode subassembly support 56 is welded to the holder 55 and brazed to the tubular insulator 29 of the cathode subassembly 11. A cap 57 is secured to the holder 55 for protecting the personnel from the high voltages present. A member 59 (FIG. 1) is secured to the holder 55 for engagement with micrometers 60 and 61 (FIG. 2). The micrometers 60 and 61 cause controlled rotational motion of the holder 55 about the nearly perpendicular third axis. A plate 58, releasably secured to the casing 48, overlaps a flange portion of the holder 55 to secure the cathode subassembly 11 to the electron gun apparatus 10 while permitting the rotation of the cathode subassembly relative to the electron gun apparatus.

Note that if the plate 58 is removed from the casing 48, the cathode subassembly 11 can be readily withdrawn from the electron gun apparatus 10, for example, for replacing the filament 12. The filament replacement is accomplished by unscrewing the clamp 27 to release the cathode support 26 with the filament leads 77 from, respectively, the base 28 and the socket 78. Moreover, the grid/anode subassembly 17 can easily be removed from the pedestal 38. The grid 13 and the anode 15 can then be easily removed from the grid-/anode subassembly: for example, for cleaning or replacement.

An evacuated chamber is provided for housing the cathode 12, the grid 13, and the anode 15. A portion of the evacuated chamber comprises resilient bellows 64 interconnecting the movably mounted cathode subassembly 11 and the fixedly mounted grid/anode subassembly 17 to permit mechanical adjustment of the cathode subassembly. A plurality of O-rings 66, 67, and 70 are provided to prevent leakage of air into the evacuated chamber.

At this juncture, it is important to note that while this particular embodiment was constructed for use with a line filament, a slotted grid, and a slotted anode, the invention is also suitable and highly desirable for use with the more conventional hairpin or pointed filaments, and grids and anodes having circular apertures. In such cases, the tilting motion about the latitudinal axis (X-axis) and the beam axis (Z-axis) might not be necessary. Further, although this particular embodiment uses a directly heated wire filament as an electron source, it is also possible to use other types of electron sources; e.g., field emission tips. In such cases, it may be desirable to provide an additional tilting motion about the longitudinal axis (Y-axis). Additionally, while this invention is described in the context of video recording apparatus, it has applications in other areas where the positioning flexibility and mechanical stability of the electron source are of particular importance: for example, electron lithography, electron microscopy, to name a few.

Thus, an electron gun apparatus has a cathode subassembly which is mechanically adjustable relative to a fixedly mounted and registered grid/anode subassembly. According to another feature of the invention, the electron gun apparatus includes a slotted grid, a slotted anode, and a line filament for providing an electron beam having an elongated cross-section. The advantages of the above-described electron gun apparatus are, inter alia, (1) reduction of problems, such as thermal drift and vibrations, due to unit construction of the grid/anode subassembly, (2) ability to make adjustments of the cathode relative to the fixedly mounted and registered grid/anode subassembly from outside the evacuated chamber while the electron gun apparatus is operative (i.e., energized, evacuated, etc.), (3) ability to readily remove the cathode subassembly, for example, for replacing the filament, (4) ability to readily remove the grid/anode subassembly, for example, for cleaning the grid or anode, (5) use of resilient bellows to increase the flexibility of cathode motion relative to the grid/anode subassembly, and to reduce leakage of air into the evacuated chamber, and (6) ability to adjust the cathode relative to the fixedly mounted and registered grid/anode subassembly in a number of ways: for example X-motion, Y-motion, Z-motion, tilt around X-axis, and tilt around Z-axis.

What is claimed is:

1. A mechanically adjustable electron gun apparatus comprising:

1. an evacuable chamber;
2. an electron gun pedestal located within said evacuable chamber;
3. a cathode subassembly including a cathode for providing a beam of electrons along an axis of said electron gun;
4. a grid/anode subassembly including:
   A. a grid having an aperture;
   B. an anode having an aperture; and C. means for fixedly mounting said grid to said anode; said mounting means serving to establish and maintain said apertures of said grid and said anode in spatial registration, while electrically isolating said grid from said anode;

5. means for securing said grid/anode subassembly to said electron gun pedestal; said grid/anode subassembly securing means serving, in common, to fixedly locate positions of said registered apertures of said grid and said anode within said evacuable chamber;

6. means, independent of said grid, said anode and said grid/anode subassembly securing means, for movably supporting said cathode subassembly with respect to said electron gun pedestal; said cathode subassembly supporting means permitting the mechanical adjustment of the location of said cathode within said evacuable chamber with respect to said fixedly located positions of said apertures without disturbing the registration of said apertures;

7. means for selectively evacuating said evacuable chamber; and 8. means for selectively energizing said anode, said grid and said cathode.

2. A mechanically adjustable electron gun apparatus as defined in claim 1 wherein said cathode comprises a line filament for providing an elongated beam of electrons along said axis of said electron gun; wherein said apertures of said grid and said anode are also elongated; wherein said apertures define a longitudinal axis and a latitudinal axis in quadrature; and wherein the dimension of each aperture along said longitudinal axis is substantially greater than the dimension thereof along said latitudinal axis.

3. A mechanically adjustable electron gun apparatus as defined in claim 2 wherein said cathode subassembly supporting means comprises:

1. a first slide reciprocably mounted to said electron gun pedestal for translatory motion along a first axis parallel to said latitudinal axis;
2. a second slide reciprocably mounted to said first slide for translatory motion along a second axis parallel to said longitudinal axis;
3. a housing tiltably mounted on said second slide for pivotal motion about an axis parallel to said latitudinal axis;
4. a casing reciprocably mounted to said housing for translatory motion along a third axis which is nearly perpendicular to a plane defined by said longitudinal axis and said latitudinal axis; and
5. a holder rotatably mounted on said casing for rotational motion about an axis parallel to said nearly perpendicular third axis, and wherein said cathode subassembly is demountably secured to said holder.

4. A mechanically adjustable electron gun apparatus as defined in claim 3 including means for reciprocably mounting said casing to said housing for translatory motion along said nearly perpendicular third axis; wherein said reciprocable mounting means comprises:

1. a skirt having a threaded portion for cooperation with a threaded portion on said housing; wherein the rotation of said skirt relative to said housing causes translatory motion of said skirt along said nearly perpendicular third axis;
2. means for coupling said translatory motion of said skirt to said casing;
3. means for preventing rotation of said casing with respect to said housing; and
4. means for causing rotation of said skirt relative to said housing.

5. A mechanically adjustable electron gun apparatus as defined in claim 4 wherein said means for causing rotation of said skirt relative to said housing comprises:

1. a worm wheel secured to said skirt; and
2. a worm rotatably mounted to said casing for engagement with said worm wheel.

6. A mechanically adjustable electron gun apparatus as defined in claim 3 wherein said selectively energizing means comprises:

1. a first conductor for electrically coupling said anode to an anode terminal which is maintained at an anode potential;
2. a flexible conductive finger electrically coupled to said grid; wherein said cathode subassembly includes a second conductor which engages said flexible finger when said cathode subassembly is supported in operative position to electrically couple said grid to a grid terminal which is maintained at a grid potential; wherein said second conductor, said flexible finger, and said grid are electrically isolated from said first conductor, and said anode; and wherein said second conductor/flexible finger engagement permits said mechanical adjustment of said movably supported cathode subassembly relative to said grid/anode subassembly, while maintaining said electrical coupling between said second conductor and said flexible finger; and
3. a pair of conductors secured to said cathode subassembly for electrically coupling the two ends of said line filament to a pair of cathode terminals maintained at cathode potentials; wherein said pair of conductors and said cathode are electrically isolated from said first conductor, said anode, said second conductor, said flexible finger, and said grid.

7. A mechanically adjustable electron gun apparatus as defined in claim 1 wherein a portion of said evacuable chamber comprises resilient bellows interconnecting said movably supported cathode subassembly and said grid/anode subassembly to permit said mechanical adjustment of the location of said cathode.

8. A mechanically adjustable electron gun apparatus comprising:

1. an evacuable chamber;
2. an electron gun pedestal within said evacuable chamber;
3. a cathode subassembly including a cathode for providing a beam of electrons along an axis of said electron gun;
4. a grid/anode subassembly including:
   A. a grid having an aperture;
   B. an anode having an aperture; and
   C. means for fixedly mounting said grid to said anode; said mounting means serving to establish and maintain said apertures of said grid and said anode in spatial registration, while electrically isolating said grid from said anode;
5. means for securing said grid/anode subassembly to said electron gun pedestal; said grid/anode subassembly securing means serving, in common, to fixedly locate positions of said registered apertures of said grid and said anode within said evacuable chamber;
6. means, independent of said grid, said anode and said grid/anode subassembly securing means, for movably supporting said cathode subassembly with respect to said electron gun pedestal; said cathode subassembly supporting means permitting the mechanical adjustment of the location of said cathode within said evacuable chamber with respect to said fixedly located positions of said apertures without disturbing the registration of said apertures;

7. means for selectively evacuating said evacuable chamber;

8. means for selectively energizing said anode, said grid and said cathode; and 9. means, operable from regions external to said evacuable chamber, for causing said mechanical adjustment of the location of said cathode.

* * * * *